US005702353A

United States Patent [19]

Guzzini et al.

[11] Patent Number: 5,702,353

[45] Date of Patent: Dec. 30, 1997

[54] HYDROMASSAGE BATHTUB WITH WIDE-BEAM ULTRASOUND EMISSION DEVICES

[75] Inventors: Virgilio Guzzini, Recanati; Enrico Montangero, Milan; Roberto Onori, Fermo, all of Italy

[73] Assignee: Teuco Guzzini S.r.l., Italy

[21] Appl. No.: 630,971

[22] Filed: Apr. 8, 1996

[30] Foreign Application Priority Data

Apr. 14, 1995 [IT] Italy ..... MI95A0778

[51] Int. Cl.[6] ..... A61H 1/00

[52] U.S. Cl. ..... 601/2

[58] Field of Search ..... 601/2, 4, 148, 601/156, 157, 158, 166, 167

[56] References Cited

U.S. PATENT DOCUMENTS 5,339,804 8/1994 Kemp ..... 601/2

*Primary Examiner*—Marvin M. Lateef

*Assistant Examiner*—Derrick Fields

*Attorney, Agent, or Firm*—Shlesinger, Fitzsimmons & Shlesinger

[57] ABSTRACT

A hydromassage bathtub with ultrasound micromassage system comprising a plurality of ultrasound emission devices (13, 113) distributed over the walls of the bathtub. The ultrasound emission devices (13, 113) comprise means (23, 26; 118, 125) for orientating the direction of emission of the ultrasounds into a wide beam, at least 10 cm. wide at a distance of 20 cm. from the source. In case of conical beam, the means orient the beam into a solid angle of not less than 30° and advantageously at least 50°. With one ultrasonic emitting element (24) inside the emission device the emission beam obtained is superior to the natural width or divergence of said element.

15 Claims, 3 Drawing Sheets

HYDROMASSAGE BATHTUB WITH WIDE-BEAM ULTRASOUND EMISSION DEVICES

BACKGROUND OF THE INVENTION

This invention refers to an innovative bathtub comprising a waterflow macromassage, or hydromassage, and an ultrasound micromassage system. In particular, this invention refers to the realization of an efficient distribution of ultrasonic waves in the water in the bathtub.

EP-A-0 651 987 filed by the same applicant describes a bathtub having a waterflow macromassage system together with an ultrasound micromassage system.

The general scope of this invention is to provide a bathtub with a micro and macromassage system as described in the aforementioned application, which offers improved operating efficiency, with distribution of the ultrasonic waves that increases the body surface treated, reduces blind areas and makes it possible to maintain the power density of the waves in the water substantially within a pre-established range.

SUMMARY OF THE INVENTION

This scope is achieved according to the invention by providing a hydromassage bathtub with an ultrasonic micromassage system comprising a plurality of ultrasound emitting devices distributed over the walls of the bathtub, characterized by the fact that the ultrasound emitting devices comprise orienting means for producing ultrasonic beam which is at least 10 cm. wide at a distance of 20 cm. from the bathtub wall.

BRIEF DESCRIPTION OF THE DRAWINGS

The innovative principles of this invention and its advantages with respect to the known technique will be more clearly evident from the following description of a possible exemplificative embodiment applying such principles, with reference to the accompanying drawings, in which.

DETAILED DESCRIPTION OF THE INVENTION

Figure 1:
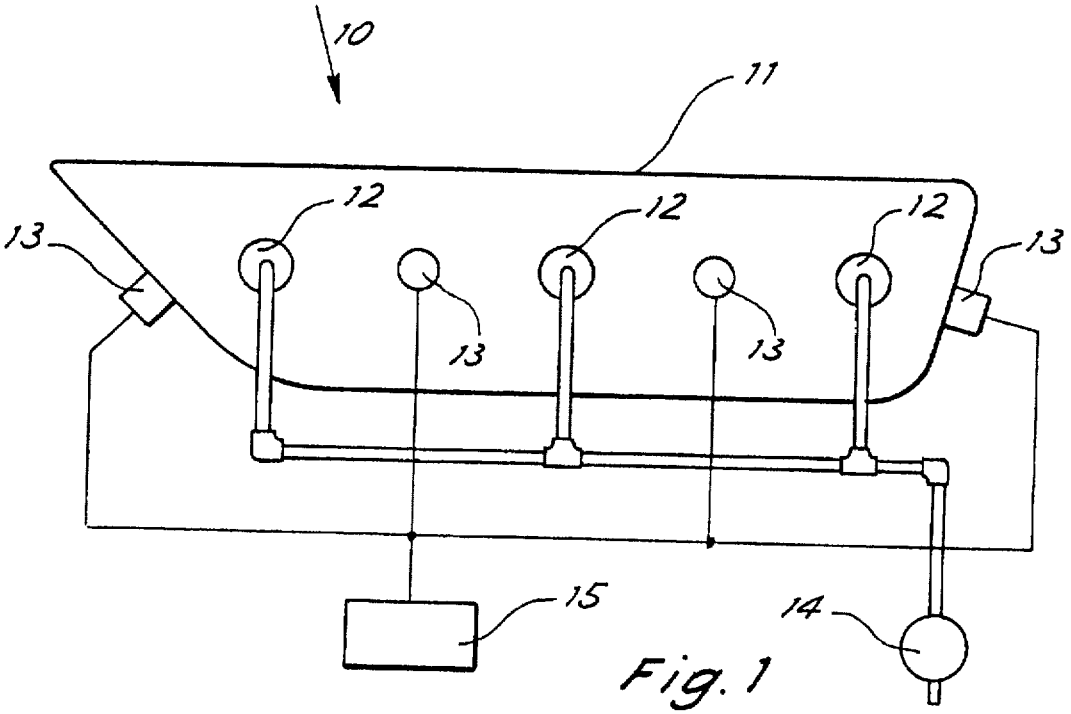
FIG. 1 shows a schematic side view of a bathtub made according to the invention.

With reference to the figures, FIG. 1 shows a system 10 according to the invention, comprising a bathtub 10 the walls of which are fitted with a hydromassage system comprising a plurality of nozzles or apertures 12 for emission of jets of water and a plurality of ultrasonic wave emitting devices 13, the former connected to a circulating pump 14 and the latter connected to one or more electric ultrasonic frequency generators 15. The hydromassage system part is substantially a known type of hydromassage system, and consequently will not be described here in greater detail since it can be easily imagined by the expert in the field. In particular, when in operation the nozzles 12 emit jets of water mixed with air to generate turbulence in the water thereby providing a macromassage effect on the body of the user.

The ultrasound emitters emit ultrasonic waves that are propagated through the water to develop a micromassaging action on the body of the user.

As described in the aforesaid patent application EP-A-0 651 987, a micromassage action together with the macromassage action produces appreciable beneficial and tonifying effects.

According to the innovative principles of this invention, it has been found that the spatial distribution and uniformity of the treatment improve considerably when the number of ultrasonic emitters is limited, with each emission device emitting with a wide wavefront, greater than the conventional beam width of the known ultrasonic emitters. In particular, it has been found to be advantageous for the width of the beam emitted by each device 13 of the plurality to be at least 10 cm. at a distance of 20 cm. from the bathtub wall. The emission can be either cylindrical or conical, It has been also found to be advantageous for the width of the conical emission to be not less than 30°, preferably more than 40°, in particular at least 50° (for example, one value used is 60°). The input power of each emitter is advantageously ranging from 100 mW and 5 W and frequency ranging from 0.5 MHz and 5 MHz. The power on the immersed body can advantageously be at least 100 mW/sq.cm.

Ultrasound emission devices have also been provided, which comprise means for orientating the direction of emission of the beam into a pre-established solid angle.

Figure 2:
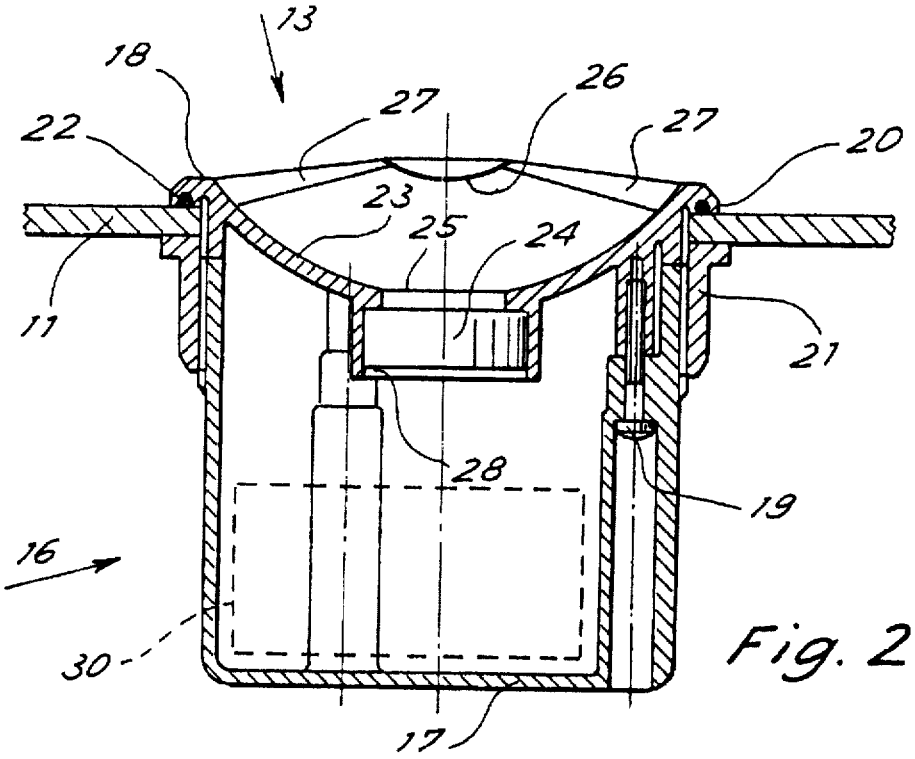
FIG. 2 shows a schematic cross-sectional view of an ultrasonic emitter made according to the invention.
Figure 3:
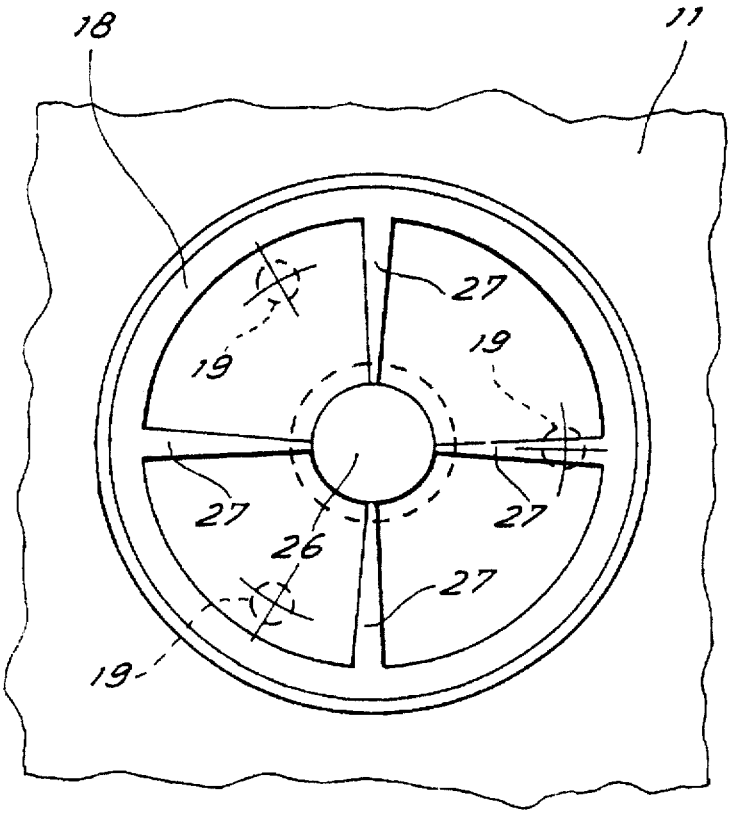
FIG. 3 shows a front view of the emitter of FIG. 2.

FIG. 2 shows a first embodiment of an ultrasound emitting element applying the innovative principles of this invention.

The emitting device 13 comprises a box-shaped casing 16 composed of a posterior shell 17 and a front cover 18 interconnected by means of screws 19. The device 13 looks out from the wall of the tub through a through hole in the wall and is secured in place by means of a ledge 20, protruding from the front cover on the inside of the bathtub, and a fastening ring nut 21 screwed onto a corresponding threaded area provided on the rear shell 17 to secure the edge of the hole between the ledge 20 and ring nut 21. A gasket 22 ensures the hydraulic seal of the device on the hole.

The front cover 18 is made with a surface 23 facing towards the inside of the bathtub, which is concave in shape, generically parabolic. Disposed at the centre of the concave surface 23 is an ultrasound emitting element made for example in the form of a known piezo-electric capsule 24. The emitting element 24 is received in a housing 28 in the surface 23 so as to have its emission side 25 tightly facing out from the surface 23. Disposed facing frontally towards the emitting side of the element 24 is the convex surface of a reflecting diffusing element 26 secured to the cover 18 by means of thin radial arms 27.

Like the element 26, the surface 23 is made in material which reflects the ultrasounds so that the beam of ultrasounds emitted by the emitter 24 with a relatively narrow width, bounces off the convex surface of element 26 and is reflected onto the parabolic reflector 23 which emits it towards the inside of the bathtub with a beam shape depending, as will be obvious to the expert in the field, upon the geometrical dimensions, distances and curves of the reflector 23 and the diffusing element 26. The beam can be either cylindrical or conical having width not less than 10 cm. at a distance of 20 cm. from the sources. Should the beam be conical, it has a width not less than 30° and advantageously not more than 40°–50°, and in any case decidedly more than the natural width or divergence of the source represented by the emitter 24.

Figure 6:
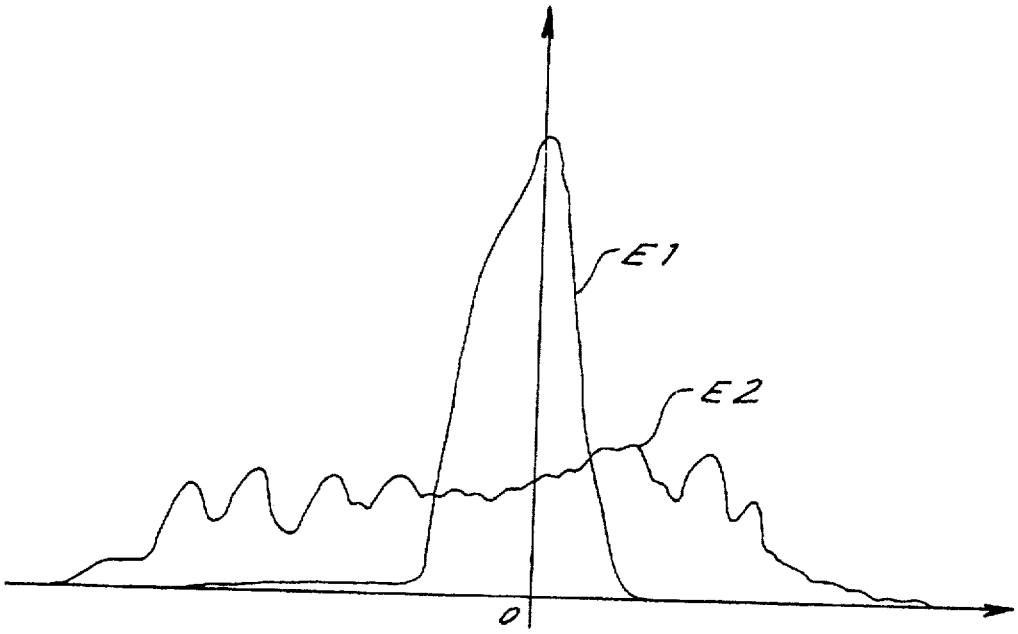
FIG. 6 shows a qualitative graph of the emission of an ultrasonic device according to the invention, compared to the emission of a generic emitter of known technique.

FIG. 6 shows an experimental graph obtained from the emitting power measured in relation to the distance from a central axis of the emitter, which compares a known type of emitter, or an emitter 24 alone (curve E1) to an emitter according to the invention (curve E2).

As can be seen, a power peak has been avoided close to the axis of emission, while a substantially uniform distribution over a wide wavefront has been obtained. This prevents localized areas of the body from being excessively stimulated and the furthermost body areas from being substantially deprived of stimulation.

Figure 4:
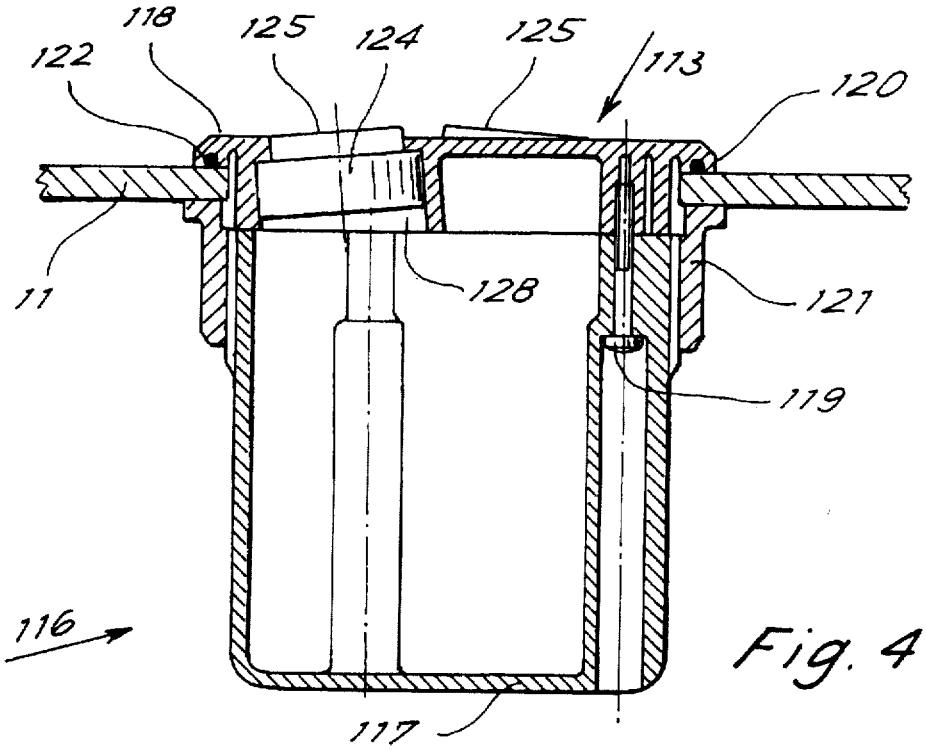
FIG. 4 shows a schematic cross-sectional view of a second embodiment of an ultrasonic emitter according to the invention.
Figure 5:
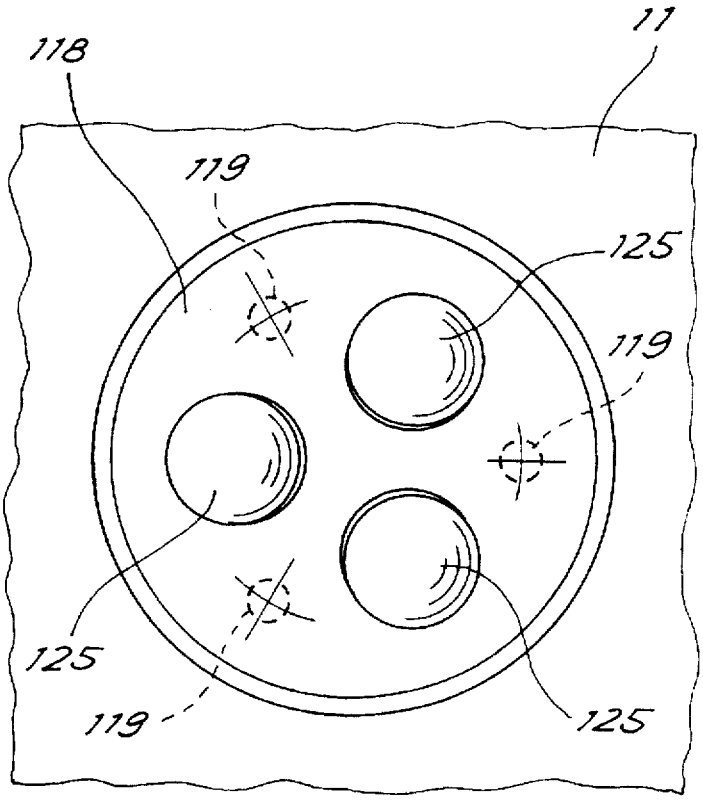
FIG. 5 shows a front view of the emitter of FIG. 4.

FIG. 4 shows a variation on the embodiment for the ultrasonic beam emitting devices.

The aforesaid figure shows an emitting device 113 comprising a box-shaped casing 116 composed of a rear shell 117 and a front cover 118 interconnected by means of screws 119. The device 113 looks out from the wall of the bathtub through a through hole in the wall and is secured in place by means of a ledge 120, protruding from the front cover on the inside of the bathtub, and a fastening ring nut 121 screwed onto a corresponding threaded area provided on the rear shell 117 to secure the edge of the hole between the ledge 120 and ring nut 121. A gasket 122 ensures the hydraulic seal of the device on the hole. The front cover 118 embodies means for orientating the emission having three housings 128 each of which receives an ultrasound emitting element 124, made for example in the form of a known piezo-electric capsule. The emitters 124 are disposed at the top of an equilateral triangle.

Each emitting element 124 is received in its respective housing 128 so as to have its emitting side 125 tightly facing out from the front surface of the cover. The emitting surfaces 125 have their respective perpendiculars slanting away from one another so that each emitter emits a beam inclined to the axis of the circular cover 118, and slanting towards the edge of the cover. The inclinations are chosen in such a way that the three beams emitted by the three emitters are juxtaposed with one another to substantially form a composite beam with a width three times greater than the single beam and in any case not less than 30° degrees and advantageously more than 40°–50°, and in any case decidedly more than the natural divergence of the source represented by an individual emitter 124.

At this point it will be clear that the intended scopes have been attained by providing a hydromassage bathtub with ultrasound micromassage, in which the ultrasounds are emitted in discrete points but with wide beam, a fact which has surprisingly been found to be more efficient as compared, for example, to a large number of emitters with a narrow beam spaced apart from one another.

A number of emitters, less than 15, in particular less than 10, has been found to be very good.

Emitters with a wide beam aperture also give a high degree of uniformity in the distribution of the power of the ultrasonic waves and reduce blind spots, which are particularly detrimental to the efficacy of the treatment. The foregoing description of embodiments applying the innovative principles of this invention is obviously given by way of example in order to illustrate such innovative principles and should not therefore be understood as a limitation to the sphere of the invention claimed herein. For example, the number and position of the emitters and nozzles may differ compared to that shown in FIG. 1 and the method of supporting the emitter 24 may differ from the arms 27. The reflecting surfaces 23 and 26 may also be different compared to those shown, so as to obtain particular distributions of power in the beam. For example, the reflectors may be convex instead of concave and viceversa.

Moreover, emitters of the types shown in FIGS. 2 and 4 may be used simultaneously.

Although the high width of the beam of ultrasounds emitted by the emitters has been found to be advantageous for the entire mass of water in the bathtub, applications in particular areas, such as for example close to the neck of the user, may also call for emitters with a conventional beam width. Moreover, as will be obvious to the expert in the field, the means for orientating the beam can be made so as to adjust the width of the beam. The ultrasound generators can be built into the ultrasonic heads, as shown schematically by the broken line indicated by reference 30 in FIG. 2.

The emitter 24 can take the place of the element 26. The head 13 can be closed hermetically on the arms 27 by an ultrasound transparency wall, as obvious from FIG. 2. The cavity can be filled with fluid, such as gel or demineralized water.

What is claimed is:

1. A hydromassage bathtub with an ultrasonic micromassage system comprising a plurality of ultrasound emitting devices distributed over the wall of the bathtub, and wherein each of the ultrasound emitting devices comprises orienting means for producing an ultrasonic beam which is at least 10 cm. wide at a distance of 20 cm. from the bathtub wall.

2. Bathtub as claimed in claim 1, wherein the orienting means orient the direction of emission of the ultrasounds into a solid angle of not less than 30°.

3. Bathtub as defined in claim 2 wherein said angle is greater than 40° and less than 50°.

4. Bathtub as claimed in claim 1, wherein each of said devices includes an ultrasonic emitter, and the orienting means of each device comprises a surface which reflects the beam emitted by the associated ultrasound emitter.

5. Bathtub as claimed in claim 4, wherein each reflecting surface orientates the beam from its associated emitter into a solid angle wider than the beam emitted by said emitter.

6. Bathtub as claimed in claim 4, wherein the reflecting surface is concave in shape, the ultrasound emitter being disposed at the centre of the latter, and above and at a distance from the reflecting surface being disposed a diffuser facing the ultrasound emitter to direct the ultrasounds emitted from the emitter towards the reflecting surface which faces towards the inside of the bathtub.

7. Bathtub as claimed in claim 4, wherein the diffuser is supported facing the ultrasound emitter by means of radial supporting arms disposed between the diffuser and a circumferential border of the reflecting surface.

8. Bathtub as claimed in claim 1, wherein the orienting means comprise a support for a plurality of ultrasound emitters disposed at an angle from one another.

9. Bathtub as claimed in claim 1, wherein the plurality of emitters is composed of three emitters slanted compared to one another with ultrasound emitting directions diverging from one another.

10. Bathtub as claimed in claim 1, wherein the emitting device comprises a box-shaped casing containing ultrasound sources and facing out onto the wall of the bathtub through a hole in the wall, the device being secured in place by means of its ledge protruding radially from the box-shaped casing on one side of the bathtub, and by means of a fastening ring nut disposed on the box-shaped casing to secure the edge of the hole between the ledge and the ring nut.

11. Bathtub as claimed in claim 10, wherein the emitting device comprises ultrasound frequency generators contained in the box-shaped casing and connected to the ultrasound sources.

12. Bathtub as claimed in claim 1, wherein the concavity of the reflecting surface is closed by a wall.

13. Bathtub as claimed in claim 12, wherein the concavity is filled with fluid.

14. A hydromassage bathtub with an ultrasonic micromassage system comprising a plurality of ultrasound emitting devices distributed over the wall of the bathtub, and wherein each of the ultrasound emitting devices comprises orienting means for producing an ultrasonic beam which is at least 10 cm. wide at a distance of 20 cm. from the bathtub wall, and each of said devices including an ultrasonic emitter, said orienting means of each device comprising a surface which reflects the beam emitted by the associated ultrasound emitter.

15. A hydromassage bathtub with an ultrasonic micromassage system comprising a plurality of ultrasound emitting devices distributed over the wall of the bathtub, and wherein each of the ultrasound emitting devices comprises orienting means for producing an ultrasonic beam which is at least 10 cm. wide at a distance of 20 cm. from the bathtub wall, said orienting means comprising a support having mounted thereon a plurality of ultrasound emitters disposed to emit beams inclined at angles to one another.

* * * * *